US006345409B1

(12) United States Patent
LaCroix

(10) Patent No.: US 6,345,409 B1
(45) Date of Patent: Feb. 12, 2002

(54) VACUUM NOZZLE FOR CLEANING CEILING FAN BLADES

(76) Inventor: John P. LaCroix, Box 363, Water Valley, Alberta (CA), T0M 2E0

( * ) Notice: Subject to any disclaimer, the term of this patent is extended or adjusted under 35 U.S.C. 154(b) by 0 days.

(21) Appl. No.: 09/770,176

(22) Filed: Jan. 29, 2001

(51) Int. Cl.[7] ..... A47L 5/00

(52) U.S. Cl. ..... 15/394; 15/395; 15/398; 134/21

(58) Field of Search ..... 15/394, 395, 398; 134/21

(56) References Cited

U.S. PATENT DOCUMENTS

| | | | | | |
|---|---|---|---|---|---|
| 2,487,444 | A | * | 11/1949 | Ines | 15/394 |
| 2,608,710 | A | * | 9/1952 | Zaidan | 15/394 |
| 2,611,917 | A | * | 9/1952 | Ventsias et al. | 15/394 |
| 2,652,583 | A | * | 9/1953 | Tomanica | 15/394 |
| 2,804,640 | A | * | 9/1957 | Zaidan | 15/394 |
| 2,821,736 | A | * | 2/1958 | Kasper | 15/394 |
| 3,110,923 | A | * | 11/1963 | Berleme | 15/394 |
| 3,520,018 | A | * | 7/1970 | Zaidan | 15/394 |
| 4,823,431 | A | * | 4/1989 | Carpenter | 15/394 |
| 5,018,944 | A | | 5/1991 | Bielecki et al. | |
| 5,235,722 | A | | 8/1993 | Harris | |
| 5,313,687 | A | | 5/1994 | Schneider | |
| 5,337,445 | A | | 8/1994 | Harris et al. | |
| 5,359,751 | A | | 11/1994 | Bellardini | |
| 5,410,776 | A | | 5/1995 | Schneider | |
| 5,488,754 | A | | 2/1996 | Shadley | |
| 5,765,259 | A | | 6/1998 | Cika | |

* cited by examiner

*Primary Examiner*—Robert J. Warden, Sr.
*Assistant Examiner*—Theresa T. Snider
(74) *Attorney, Agent, or Firm*—Sean W. Goodwin

(57) ABSTRACT

A vacuum nozzle attachment having a housing with a venturi-shaped internal air chamber, an angled head and brush-lined aperture, blade guides and an offset tapered tubular neck for attachment to a vacuum hose or wand. The constricted air chamber provides enhanced suction due to an increase in velocity of air as it passes the tapered constriction in the air chamber. The angled head and aperture and shaped guides ensure correct alignment of the fan blade with the aperture. The offset tubular neck and transparent guides provide an unobstructed view of the nozzle and fan blades during the cleaning process.

8 Claims, 6 Drawing Sheets

VACUUM NOZZLE FOR CLEANING CEILING FAN BLADES

FIELD OF THE INVENTION

The invention relates generally to a cleaning device and more particularly to a nozzle attachment for a vacuum for cleaning ceiling fan blades.

BACKGROUND OF THE INVENTION

Ceiling fan blades, due to their orientation, rapidly collect dust on their upward facing surfaces and must be cleaned on a regular basis to maintain the motor in good working order and to provide a clean and desirable environment. In household use, fans are also likely to accumulate a layer of grease to which the dust adheres, making cleaning more difficult.

Typically, due to free rotation of the blades and the height of most ceilings, an individual must use a chair or a ladder to access the upper surface of the blade with some conventional type of cleaning device. One hand is used to steady the blade while the other is engaged in either manually wiping the blade or operating a device to clean the blade's surfaces. In most cases, unless a tall ladder is used, the individual is working over their heads and is unable to visually confirm the cleanliness of the blade. Further, the body mechanics of the situation are poor and the potential for accidents is great.

A number of different devices to assist in cleaning ceiling fan blades are known and described in the prior art. Some of these apparatus, such as U.S. Pat. No. 4,841,592 to Restivo employ cleaning elements such as sponges arranged on extensible handles to clean the blades, while others such as U.S. Pat. No. 5,018,944 to Bielecki, attempt to dissuade dust from adhering to the surface of the fan blade by positioning a non-rotating brush above the rotating fan blades and gently brushing off the dust with each pass of the blades.

A variety of vacuum nozzle attachments have been described to be attached to vacuum cleaner hoses and wands to facilitate easy removal of dust and dirt from all surfaces of ceiling fan blades. In U.S. Pat. No. 5,765,259 to Cika, a fan blade cleaning device is described comprising a hollow rectangular head connected to the upper end of a tubular handle for attachment to a vacuum cleaner hose. The tubular handle is attached at the middle of the head creating a T-shaped attachment. A passage lined with brushes extends through the hollow head to accept a fan blade and discrete openings in the head communicate with both the blade passage and the vacuum to duct dust from all surfaces of the blade. Positioned as it is, in a T-shape, the tubular handle obscures the view of the blade to a user standing directly below the fan blade. Further, most fan blades are angled 12 degrees from horizontal, therefore in order to engage the blade the user must also attempt to angle the hose and tubular handle to position the head and passage to accept the end of the blade.

Earlier U.S. Pat. No. 5,337,445 to Harris et al. describes a hollow housing with an aperture therethrough for accepting a fan blade, the housing and aperture angled 12 degrees to improve alignment with the blade, and a tubular handle positioned offset along the end of the housing to provide the user a vertical or plumb reference for the vacuum wand during use. The aperture is brush lined and a small dust catching edge is provided on either side of the aperture to catch dust displaced as the blade enters the aperture and before it engages the vacuum. However, this device relies upon the firm engagement of the blade with the brush bristles to secure the blade and provide only sufficient space to concentrate the volume of air flow about the bristles to increase the amount of dust which is removed. Clearly, any wear to the bristles as a result of poor alignment of the blade entering the aperture or normal wear and tear as the bristles traverse the surface of the blade compromises the efficiency with which this device would remove dust.

There is a need for an improved means to safely clean ceiling fan blades, particularly one that utilizes a home vacuum cleaner, that is lightweight, easily attached to a vacuum hose and wand, readily aligned and engaged with the blade and further, that provides sufficient vacuum to effectively and efficiently remove dust and dirt from all surfaces of the blade.

SUMMARY OF THE INVENTION

The vacuum nozzle attachment of the present invention provides an improved means for safely and easily cleaning ceiling fan blades.

The lightweight housing, incorporating an air chamber with a venturi and tapered tubular neck, is readily installed on the end of a vacuum hose or wand. The offset tubular neck ensures that the user can easily visualize both the head of the housing and the ceiling fan blade. The head and brush-lined aperture, which extends therethrough, are angled at 12 degrees from horizontal relative to the tubular neck, to match the pitch of typical ceiling fan blades. The angled head and aperture assist in aligning the fan blade with the aperture. Further, shaped guides are provided on either side of the housing at the aperture to engage the edges of the fan blade to further assist in alignment.

The venturi-like shape or tapered constriction of the air chamber acts to increase the velocity of air as it passes the constriction, thus enhancing the suction at the air chamber and the top of the blade, when engaged by the nozzle. Further, the constriction causes an eddy-like pattern to the air flow which along with the enhanced suction, improves the cleaning ability of the nozzle.

DETAILED DESCRIPTION OF THE PREFERRED EMBODIMENT

Figure 1:
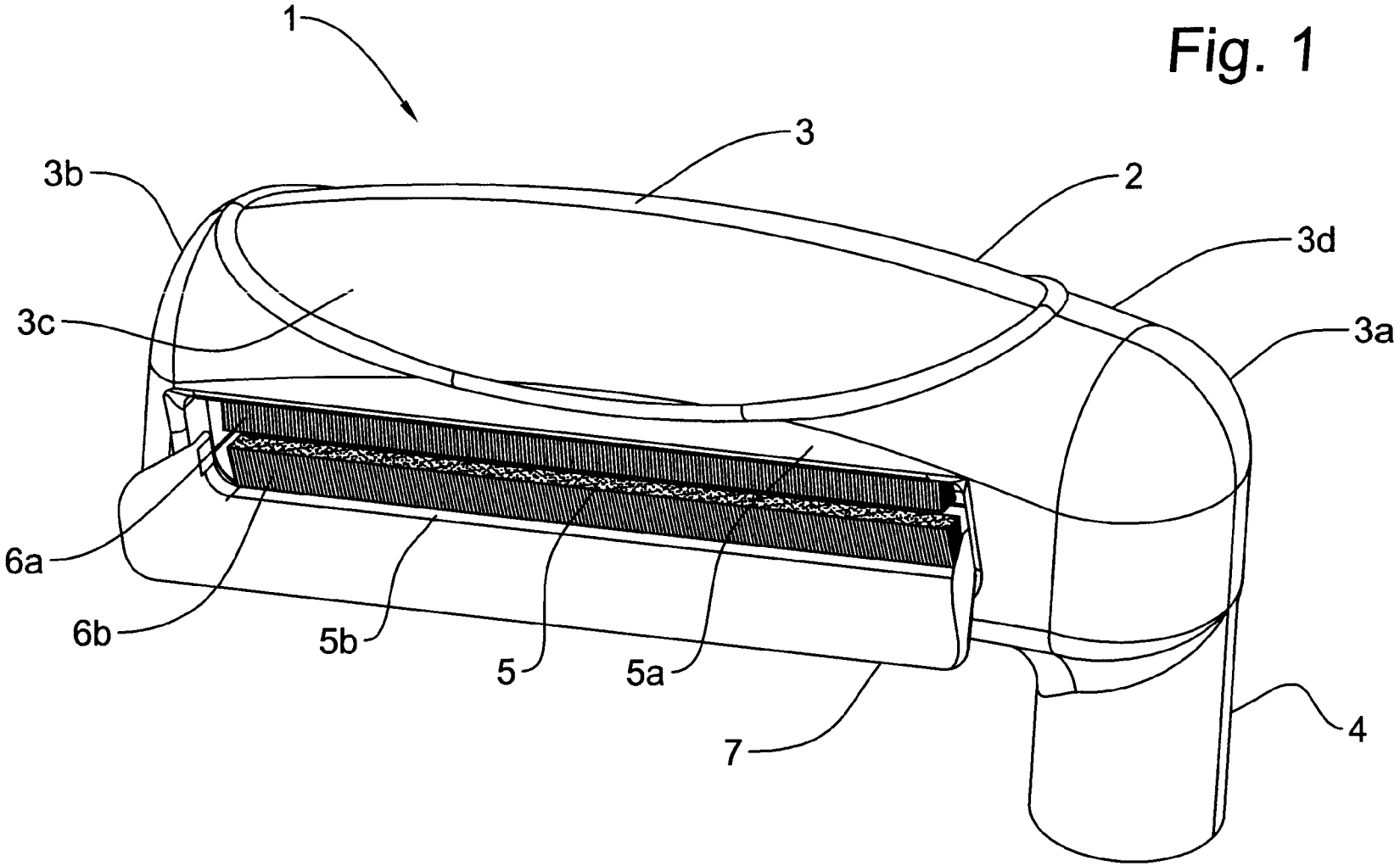
FIG. 1 is a perspective view of the vacuum nozzle attachment of the present invention.
Figure 2:
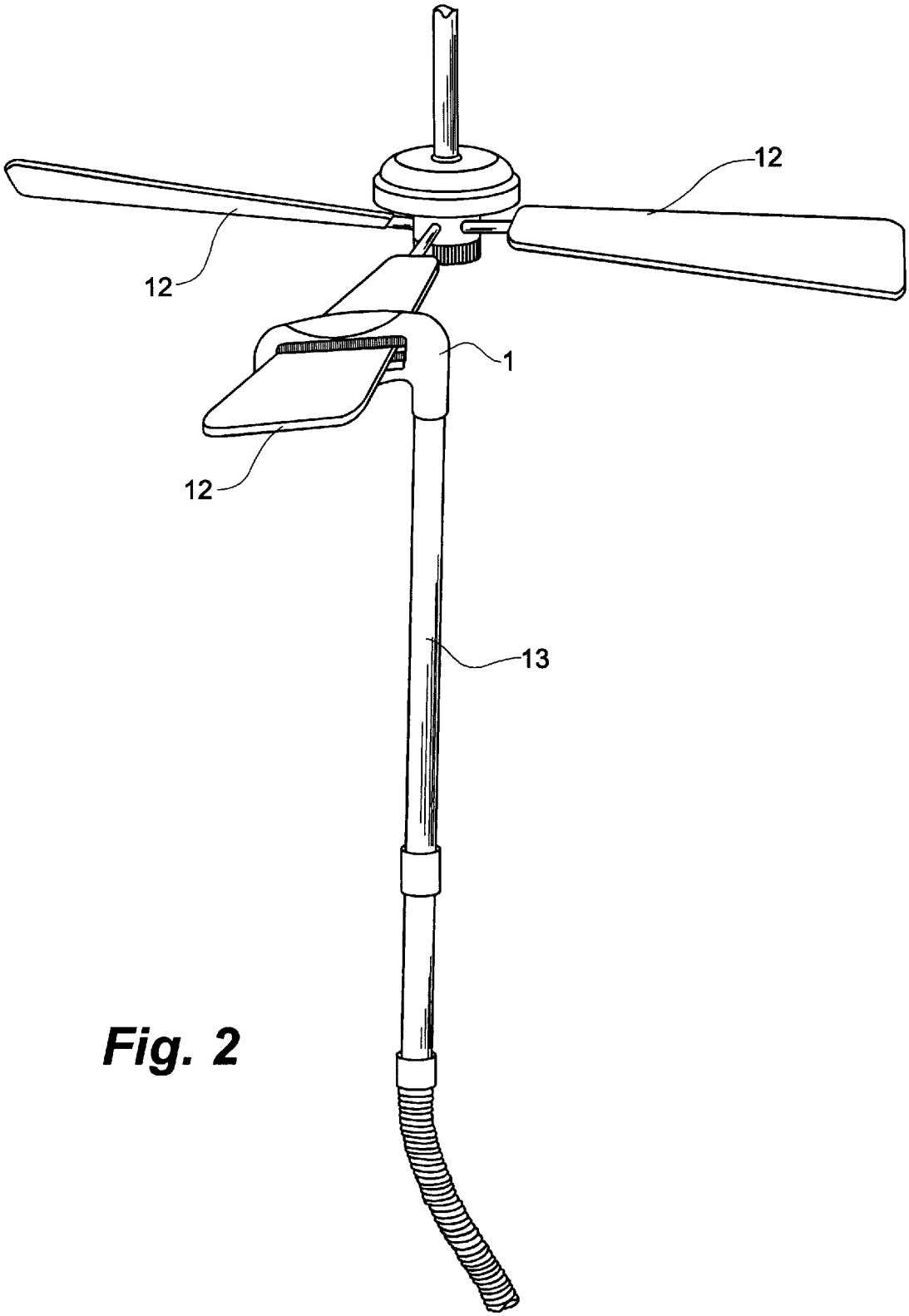
FIG. 2 is a perspective view of the vacuum nozzle attachment in use, attached to the wand of a household vacuum and engaging a fan blade in the housing aperture.

Having reference to FIGS. 1–2, a vacuum nozzle attachment 1, of the present invention, for cleaning ceiling fan blades 12, is shown. The nozzle 1 has a housing 2 comprising a generally rectangular, elongated, hollow head 3 having first and second ends 3*a*, 3*b* and two sides 3*c*, 3*d*. A tubular neck 4 for receiving a vacuum hose or wand 13 is formed at the first end 3*a* of the head 3. The second end 3*b* of the head 3 is closed. A rectangular, elongated aperture 5 extends through the head 3 from side to side 3*c*, 3*d* and is of sufficient length to receive a fan blade 12. Upper and lower bristles 6*a*, 6*b*, carried in the aperture 5, extend and converge into the aperture 5 at two long upper and lower edges of the rectangular aperture 5*a*, 5*b* on either side 3*c*, 3*d* of the head 3. A shaped guide member 7 extends outwardly from each side of the head 3*c*, 3*d*, substantially perpendicular to the sides 3*c*, 3*d*, and extending the length of the lower, long rectangular edges 5*b* of the aperture 5.

Figure 3:
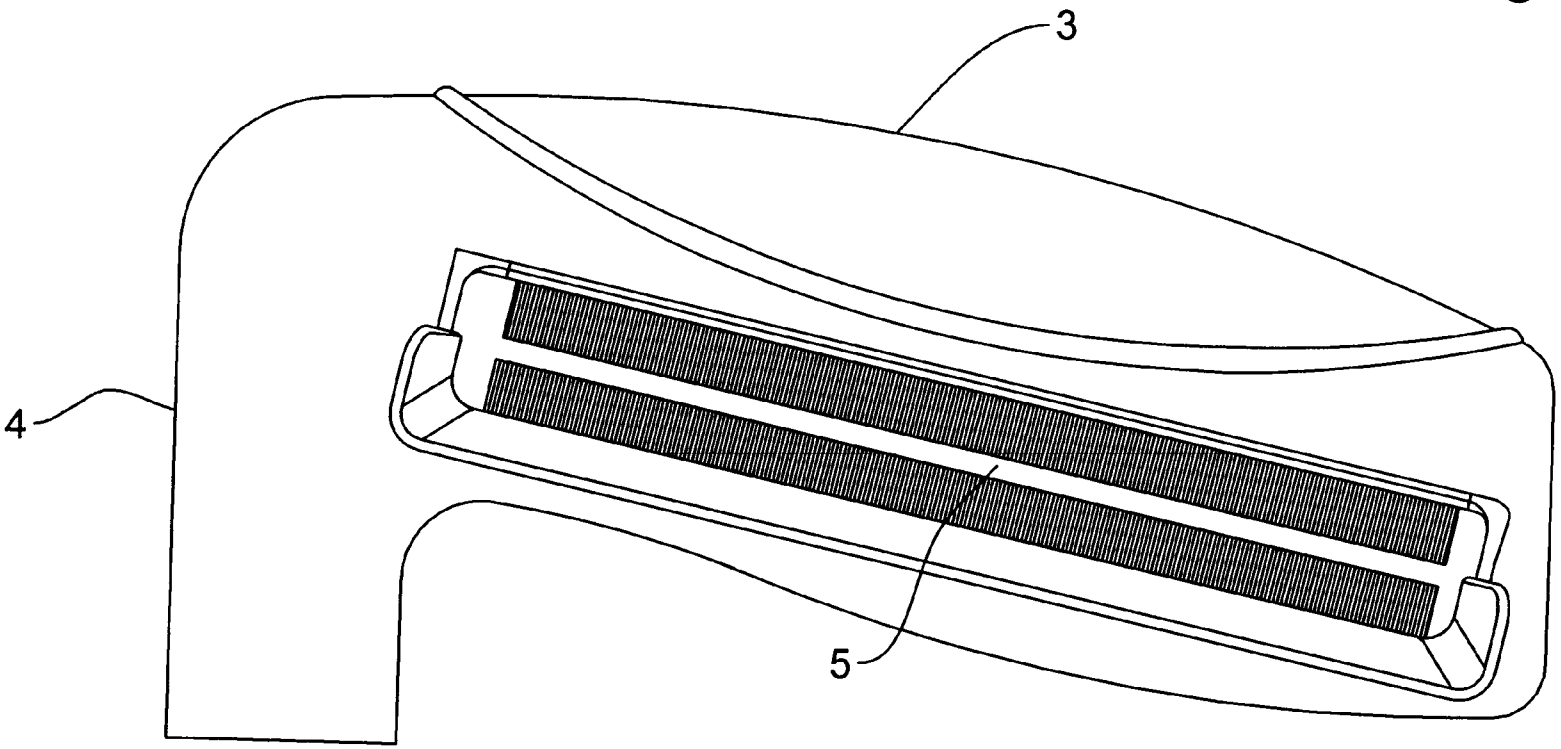
FIG. 3 is a side view of the nozzle attachment of FIG. 1 showing the 12 degree angle of the housing head and blade aperture.

As shown in FIG. 3, the nozzle head 3 and the aperture 5 are angled downward relative to the tubular neck 4. Typically, ceiling fan blades 12 are angled approximately 12 degrees from horizontal and therefore, in order to improve alignment of the aperture 5 with the blade 12, both the head 3 and aperture 5 are angled approximately 12 degrees to match that of the blade 12.

Figure 4:
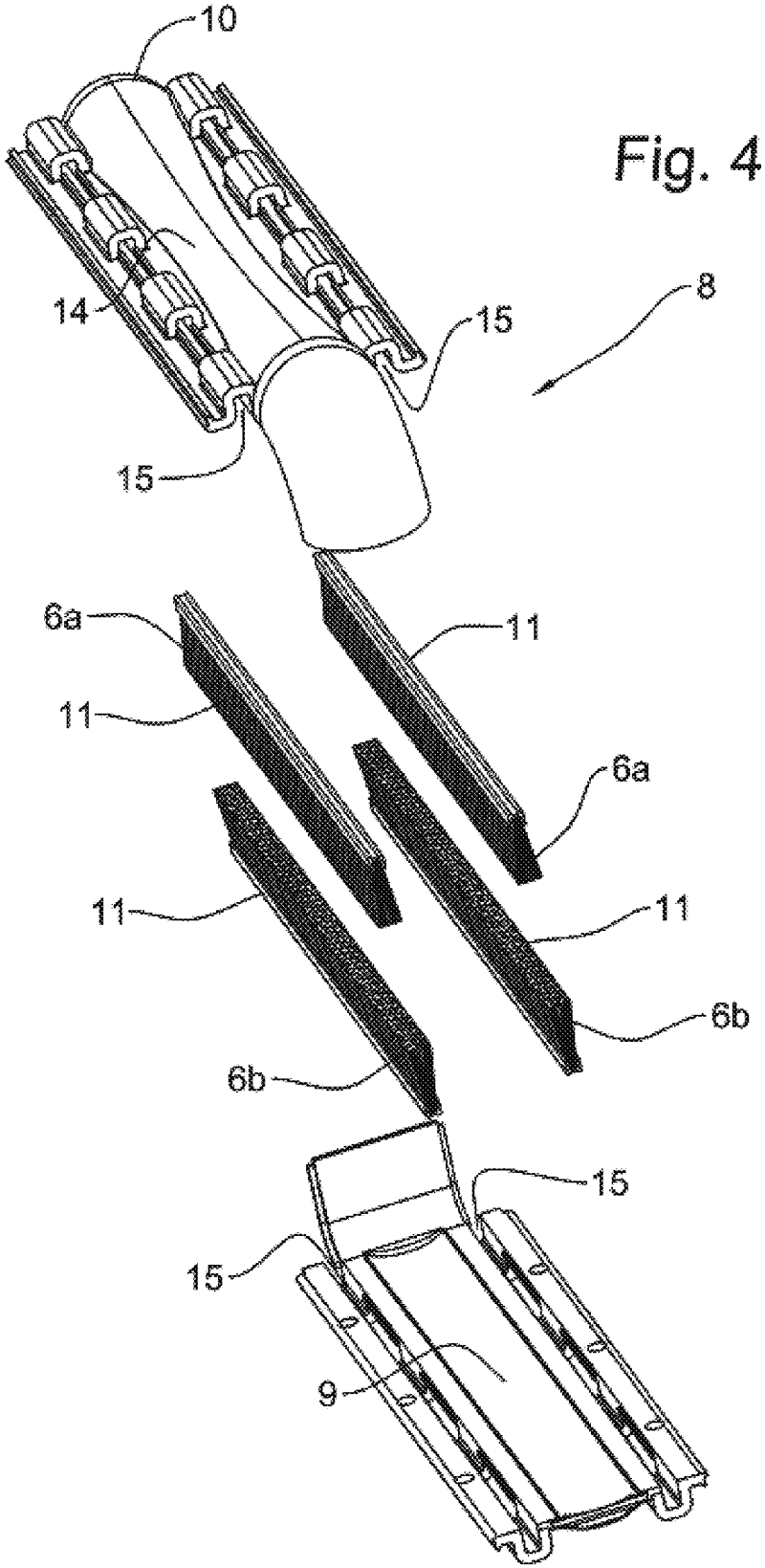
FIG. 4 is a blown-apart view of the internal air chamber and brush strips.

An inner air chamber 8, as shown in FIG. 4, is formed within the hollow head 3 of the housing 2. The air chamber 8 comprises a base plate 9, a shaped top plate 10 and brush strips 11. The brush strips 11 slide longitudinally into retaining slots 15 in the base plate 9 and shaped top plate 10. When assembled, the inner air chamber 8 is hollow and is in direct communication with the tubular neck 4 of the housing 2 and therefore with the vacuum hose or wand 13 and with the blade aperture 5. Two brush strips 11 are positioned, one on either side of the base plate 9 and two more strips 11 on either side of the shaped top plate 10. The strips protrude into the hollow air 8 chamber and extend the full length of the top and bottom of the aperture in the head 3. The bristles 6*a*, 6*b* of the brush strips 11 protrude into the blade aperture 5, sufficient to engage upper and lower surfaces 12*a*, 12*b* of the blade 12, as shown in FIG. 6, both to brush the surfaces of the blade 12 and to fit sufficient close to the surfaces 12*a*, 12*b* so as to enhance suction created by the vacuum to remove any dust and dirt dislodged by the bristles 6*a*6*b*.

The tubular neck 4 of the housing 2 is tapered so as to fit most household type vacuum hoses or wands 13. The nozzle attachment 1 is fit onto the end of the vacuum hose or wand 13 and air is drawn into the housing 2 through the air chamber 8 and into the tubular neck 4, ducting dust and dirt with it.

Figure 5:
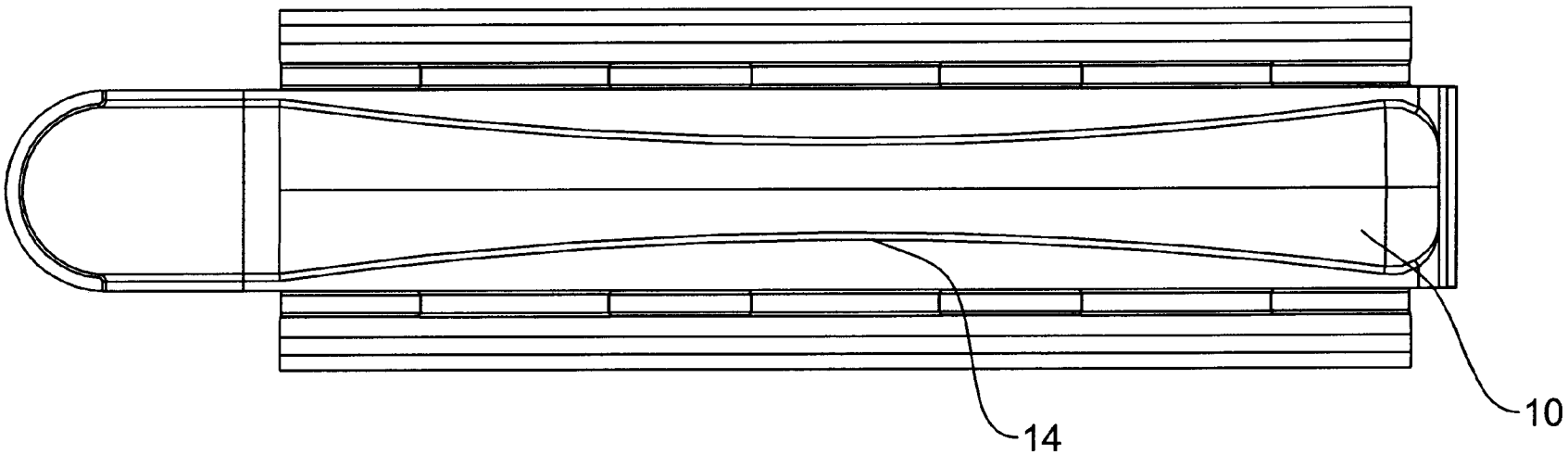
FIG. 5 is a top view of the internal air chamber showing the venturi-shaped constriction which acts to improve suction.

Having reference to FIGS. 4 and 5, the top plate 10 of the air chamber 8 is shaped having a tapering constriction 14, much like a venturi tube, at the middle of the plate 10 which corresponds to the center of the blade 12 when inserted into the blade aperture 5. As air is drawn past this constriction 14, due to the suction produced by the vacuum, its velocity is increased creating an increase in suction and an eddy-like or turbulent movement to the air. This increase in suction and air movement assists in dust and dirt removal.

Figure 6:
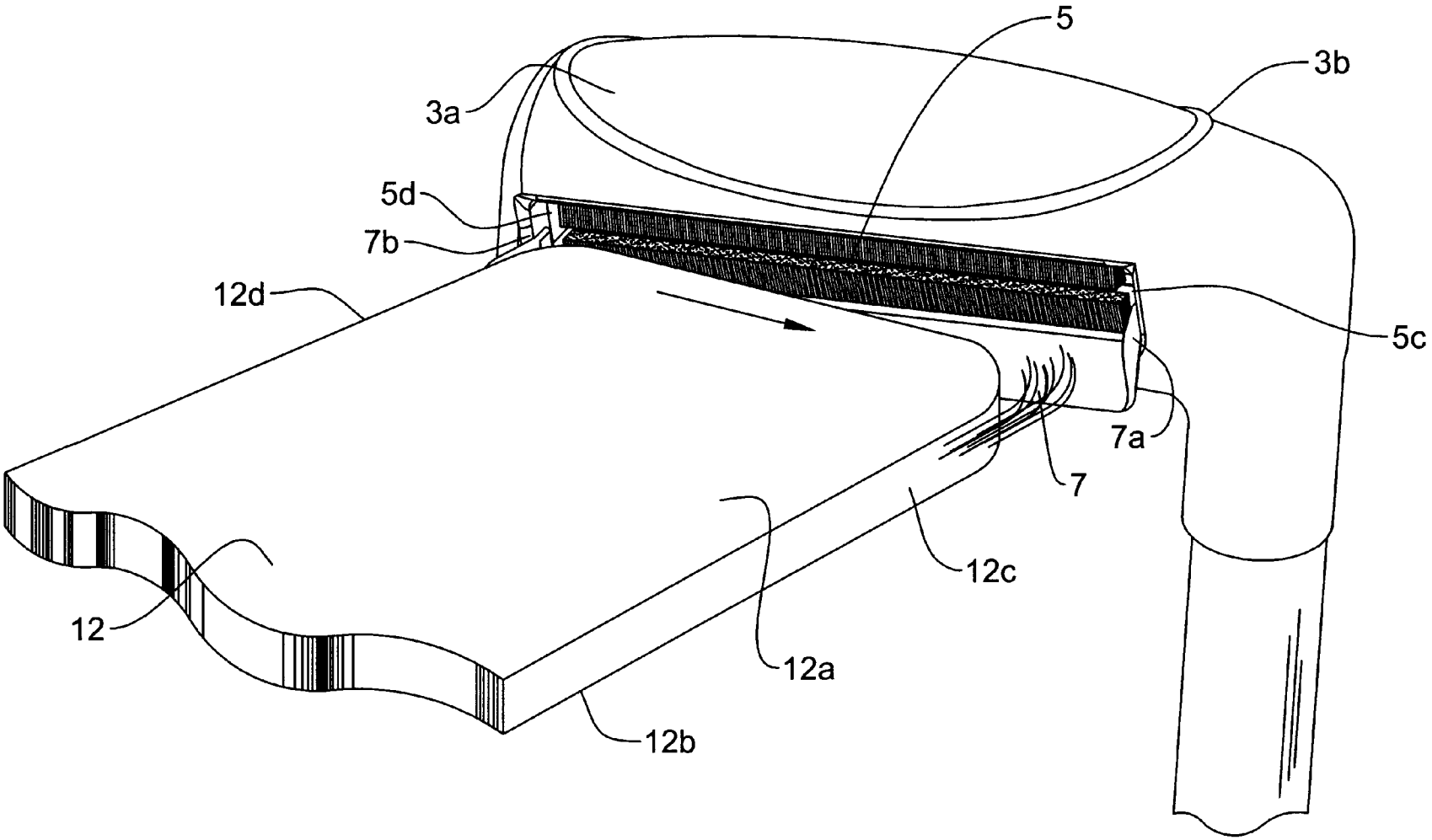
FIG. 6 is a perspective view of the blade aperture and bristles of the vacuum nozzle of the present invention engaging a fan blade.

Having reference to FIG. 6, a pair of shaped guides 7 are fit into the blade aperture 5, one on either side of the head 3*a*, 3*b*. The guides extend the entire length of the aperture 5 and are positioned along the lower edge 5*b* of the aperture. First and second ends 7*a*, 7*b* of the guide are curved upward to engage first and second ends of the aperture 5*c*, 5*d*, thus forming a generally elongate "U" shaped guide. The curved first and second ends 7*a*, 7*b* of the guide engage the blade 12 at a first or a second edge 12*c*, 12*d*, assisting in rotating the blade 12 to align with the aperture 5. Each guide 7 further acts to catch any dust or dirt dislodged from the blade 12 before it enters the aperture 5, preventing it from falling onto the operator or objects below the fan. Optionally, the guides 7 may be made of transparent material to further assist the user with visual alignment of the blade 12 and aperture 5.

The embodiments of the invention in which an exclusive privilege or property is claimed arze defined as follows:

1. An improved vacuum nozzle for cleaning ceiling fan blades, the nozzle having a housing, the housing forming an air chamber adapted for communication with a vacuum source, the housing and air chamber further having an aperture extending therethrough to accept a fan blade, the housing having brushes disposed in parallel arrangement at an upper edge and at a lower edge of the aperture on either side of the housing, the improvement comprising a constriction of the air chamber above the aperture so as to create an increase in suction to enhance cleaning of the fan blade.

2. The apparatus as described in claim 1 wherein the air chamber is constricted sufficiently so as to form turbulent air currents on the fan blade.

3. The apparatus as described in claim 1 wherein the constriction of the air chamber is located about midway between a first end and a second end of the aperture.

4. The apparatus as described in claim 3 wherein the aperture is angled from horizontal.

5. The apparatus as described in claim 3 further comprising guide members located at the lower edge of the aperture and at the first and second ends of the aperture, the guide members acting to align the fan blade into the aperture.

6. The apparatus as described in claim 5 wherein first and second ends of the guide members are curved upward to join the first and second ends of the aperture, the curved edges acting to engage the fan blade and guide it into the aperture.

7. The apparatus as described in claim 6 wherein the guide members are transparent to assist in visual alignment of the fan blade with the aperture.

8. A method of cleaning dust from ceiling fan blades comprising:

providing a vacuum nozzle having a housing with a brush-lined blade aperture for engaging a fan blade and a constricted air chamber formed in the housing above the blade aperture so as to provide improved suction at the constriction;

moving the vacuum nozzle along the surface of the fan blade; and drawing air through the air chamber and into the vacuum nozzle so as to remove dust from the fan blade.

* * * * *